United States Patent [19]

Okada

[11] 4,045,064

[45] Aug. 30, 1977

[54] LATCH MECHANISM

[75] Inventor: Yasumasa Okada, Tokyo, Japan

[73] Assignee: Nissan Motor Company, Limited, Yokohama, Japan

[21] Appl. No.: 648,690

[22] Filed: Jan. 13, 1976

[30] Foreign Application Priority Data

Jan. 17, 1975 Japan ..... 50-7511
Aug. 27, 1975 Japan ..... 50-118591[U]

[51] Int. Cl.[2] ..... E05C 3/30

[52] U.S. Cl. ..... 292/125; 292/DIG. 27; 292/DIG. 14

[58] Field of Search ..... 292/125, 126, 216, 198, 292/221, 225, 280, DIG. 14, DIG. 26, DIG. 27

[56] References Cited

U.S. PATENT DOCUMENTS

| | | | |
|---|---|---|---|
| 2,795,947 | 6/1957 | Peras | 292/DIG. 14 |
| 2,800,787 | 7/1957 | Jeavons | 292/DIG. 27 |
| 3,305,258 | 2/1967 | Peters | 292/198 |
| 3,572,790 | 3/1971 | Kapanka | 292/125 |

*Primary Examiner*—Richard E. Moore
*Attorney, Agent, or Firm*—Frank J. Jordan

[57] ABSTRACT

A latch mechanism is provided which comprises a latch member and an open member to move the latch member to its open position. The latch mechanism has a frist condition in which the latch and open members are in conjoint action and a second condition in which the latch and open members are out of conjoint action.

9 Claims, 10 Drawing Figures

LATCH MECHANISM

The present invention relates to a latch mechanism, and more particularly to a latch mechanism which is remotely operable from the interior of a vehicle.

A known latch mechanism for automobile luggage compartment includes a latch member rockable between a latched and open position and an open member secured to one end of an inner core of a Bowden cable which terminates in a push or pull button in the passenger compartment accessible to the driver. The open member has a finger positioned for engagement with an actuating portion of the latch member to move the latch member to its open position when the Bowden cable is operated. The latch member is also operable by a key from the external of the vehicle. This known latch mechanism has the disadvantage that it is always free for manual operation by the button in the passenger compartment so that any person, if allowed to drive the automobile, may open the luggage compartment under no permission by owner of the automobile without the key for the luggage compartment.

It is a main object of the present invention to provide a latch mechanism which eliminates the above mentioned disadvantage.

It is another object of the present invention to provide a latch mechanism of the above character which is simple in construction and easy to manufacture.

According to the present invention, there is provided a latch mechanism comprising a latch member; an open member to move the latch member to its open position, the open member being operable by a control member, the latch and open members being in conjoint action in a first condition and out of conjoint action in a second condition; and means whereby the latch and open members are selectively rendered to the first and second conditions.

The invention will now be more particularly described hereinafter with reference to the accompanying drawings, in which.

Figure 1:
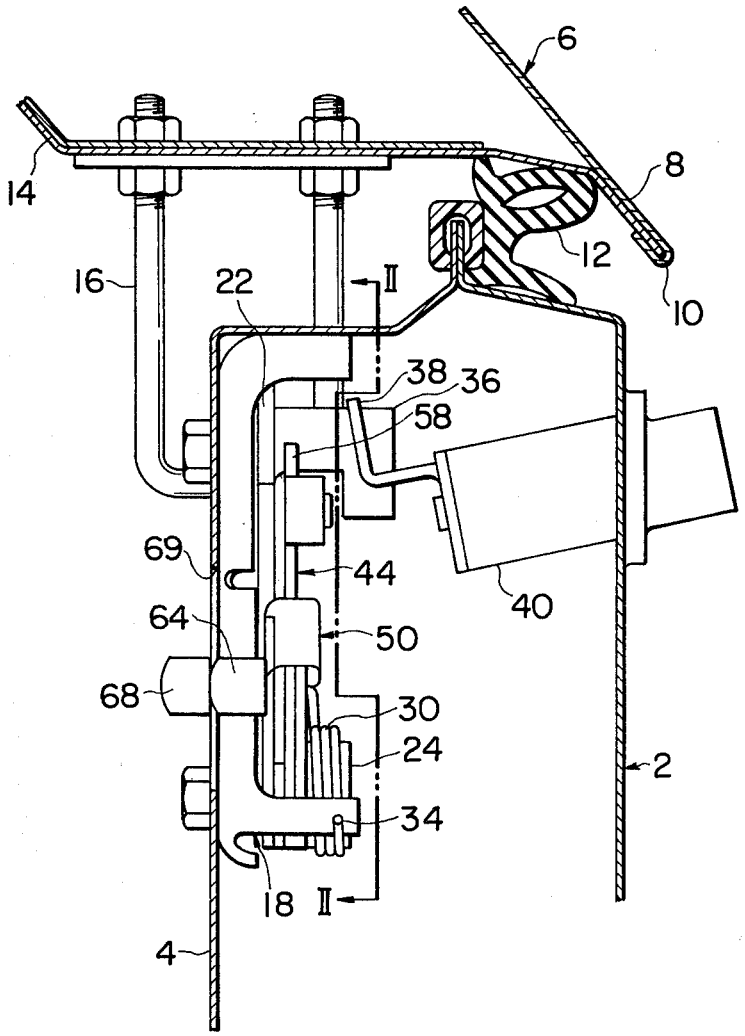
FIG. 1 is a partial sectional view through a lid for a luggage compartment and adjacent body portions of an automobile showing a first embodiment of a latch mechanism according to the present invention.

In FIG. 1 of the drawings the latch mechanism is shown as attached to an automobile, wherein numeral 2 indicates a rear element of an automobile body to which is attached an inner plate 4 defining walls of a luggage compartment. Numeral 6 indicates a lid which may have an outer face member 8 extending downwardly to a lip 10 overlapping the body element 2, a rubber seal 12, commonly being disposed therebetween. The lid 8 is hinged to a body on a transverse axis so that the lid 10 swings upwardly and outwardly from the body element 2 in opening the luggage compartment beneath the lid in the usual fashion. An inner liner member 14, spaced inwardly of the face member 8, has a transverse plate portion to which is secured a keeper 16.

The latch mechanism is mounted in a space formed between the body element 2 and inner plate 4 and comprises a casing 18 mounted on the inner plate adjacent to the lid 6. The upper edge of the casing 18 is provided with a keeper receiving slot 20 for reception of the keeper 16 within the slot 20 (see FIG. 2). A latch plate 22 is mounted on the casing 18 for pivotal movement on a pivot pin 24. The latch plate 22 has an arm 26 formed with a hooked portion 28 and is normally urged in a counter clockwise direction, as viewed in FIGS. 2 through 5, by a coil spring 30 one arm 32 of which abuts the arm 26 and the other arm 34 is anchored to the casing 18. The arm 26 comprises a transversely projecting ear 36, as an actuating portion, which is engageable by a key lever 38 which is turned to rock the latch plate 22 from a latched position (the illustrated position of the latch plate in FIG. 2 or 4) to an open position (the illustrated position of the latch plate 22 in FIG. 3 or 5). The key lever 38 is affixed to a cylinder lock 40 which is mounted in the vehicle body element 2 and which is operated by a trunk key plate (not shown). A stop 42 is formed on the casing 18 to limit counter clockwise rotation of the latch plate 22 due to the force of the spring 30 at the latched position, as viewed in FIG. 2.

An open lever, generally indicated as 44, is pivotally mounted on the pivot 24. The open lever 44 carries a stud 46 which is guided in a generally arcuate slot 48 formed in a toggle operated cancel lever 50 and is connected with the inner wire 52 of a Bowden wire device 54 which is adapted to be operated by a push or pull button mounted on a part remote from the latch mechanism. Where the latch mechanism is applied to the luggage compartment of a vehicle, as is the case in this embodiment, the button may be mounted on a dashboard of the vehicle. The open lever 44 is formed with a slot 56 in which the pivot 24 is guided and a finger 58 for engagement with the ear 36 of the latch plate to rock the same. A stop 60 is formed on the casing 18 to limit clockwise rotation of the open lever 44, as viewed in FIG. 2, due to the operation of the inner wire 52. The arm 32 of the coil spring 30 engages the perimeter of the open lever 44.

The cancel lever 50 is pivotally mounted on a pivot pin 60 and has an actuating arm 62 formed with the generally arcuate slot 48 and an arm 64 extending outwardly of the casing 18 through an opening 66. The arm 64 carries a manually operable knob 68 extending through an opening 69 formed in the inner plate 4 (see FIG. 1).

When the lid 6 is moved to closed position, the keeper 16 enters the keeper receiving slot 20 and eventually engages a sloping cam surface 70 on the latch plate 22 and forces the same in a clockwise direction (as viewed in FIGS. 2–5) against the action of the coil spring 30 until it passes the nose of the hook 28 whereupon the latch plate 22 is rotated counter clockwise by its spring and the hook 28 engages and secures the keeper 16 to lock the lid 6.

Figure 2:
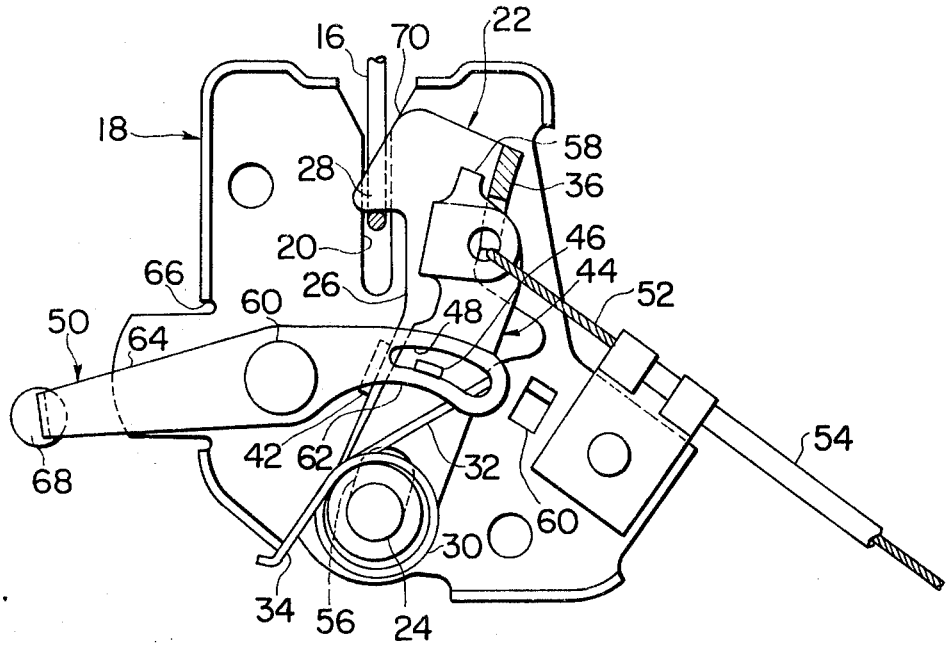
FIG. 2 is a partly sectional view through the line II—II of FIG. 1 showing the parts in latched position.
Figure 3:
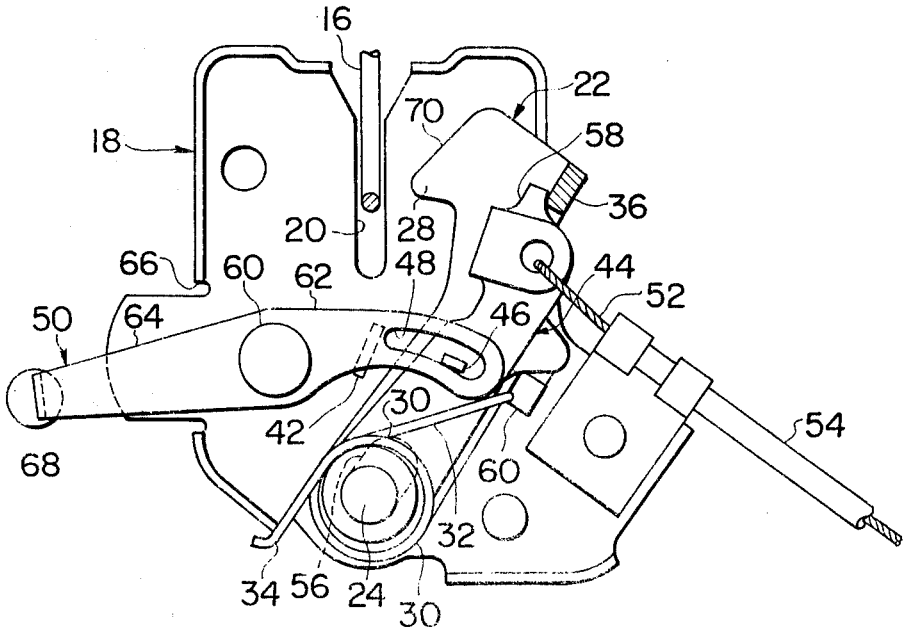
FIG. 3 is a view similar to FIG. 2 showing the parts in open or unlatched position when a Bowden wire is operated to rock an open lever.

When it is desired to open the lid 6 without alighting from the vehicle, the remote control push or pull button is operated to actuate the Bowden wire 54 and the open lever 44 is rocked about the pivot 24 in a clockwise direction, as viewed in FIG. 2, into the position shown in FIG. 3 to disengage the hook 28 from the keeper 16 which is then freed to permit the lid 6 to be manually lifted.

Figure 4:
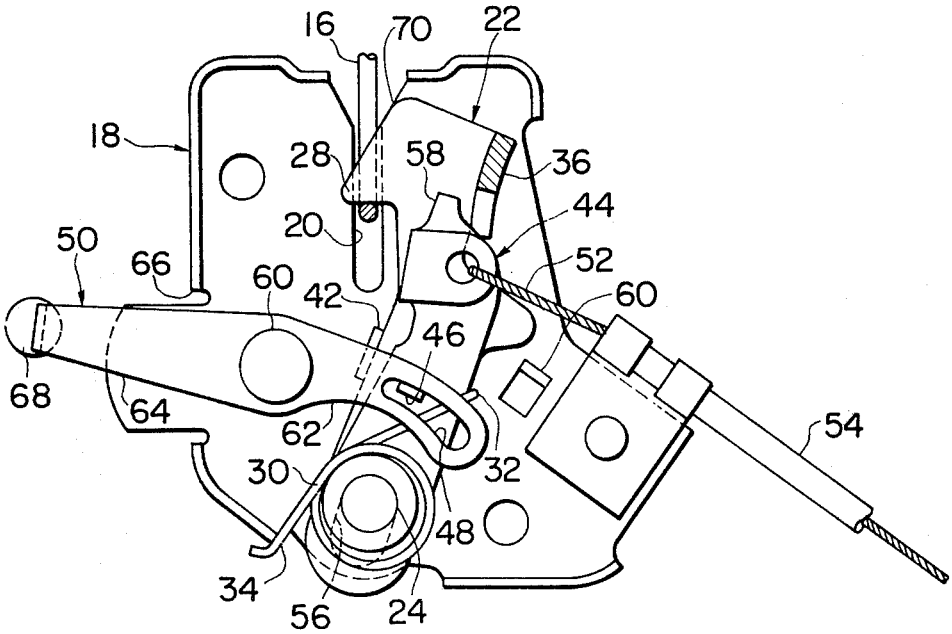
FIG. 4 is a view similar to FIG. 2 showing the parts in latched position with the open lever positioned out of operative engagement with a latch plate.

When it is desired to disable the remote control push or pull button to prevent any one from opening the lid 6, the manually operable knob 68 is operated to rock the cancel lever 50 about its pivot 60, in a clockwise direction, as viewed in FIG. 2, into the position shown in FIG. 4 to urge the stud 46 and the latch plate 22 toward the pivot 24 from the position shown in FIG. 2 in which the finger 58 is positioned for engagement with the ear 36, into the position shown in FIG. 4 in which the finger 58 is positioned out of engagement with the ear 36. The ear 36 is then displaced out of the path of rotation of the finger 58 so that operating the push or pull button to actuate the Bowden wire 54 to rock the open lever 44 about the pivot 24 from the position shown in FIG. 4 to the position shown in FIG. 5 will leave the latch plate 22 in the latched position shown in FIG. 2 or 4. It will be noted that the pivot pin 24 abuts one end of the slot 56 to define the position of the open lever 44 shown in FIG. 2 and that the pivot pin 24 abuts the opposite end of the slot 56 to define the position thereof shown in FIG. 4.

Figure 5:
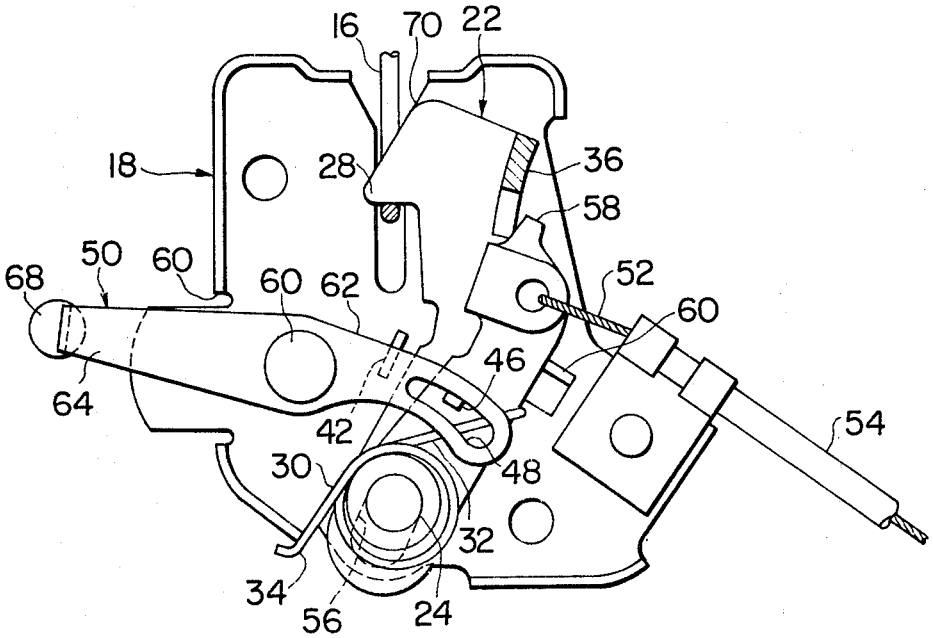
FIG. 5 is a view similar to FIG. 2 showing the parts remaining in latched position when the Bowden wire is operated to rock the open lever.
Figure 6:
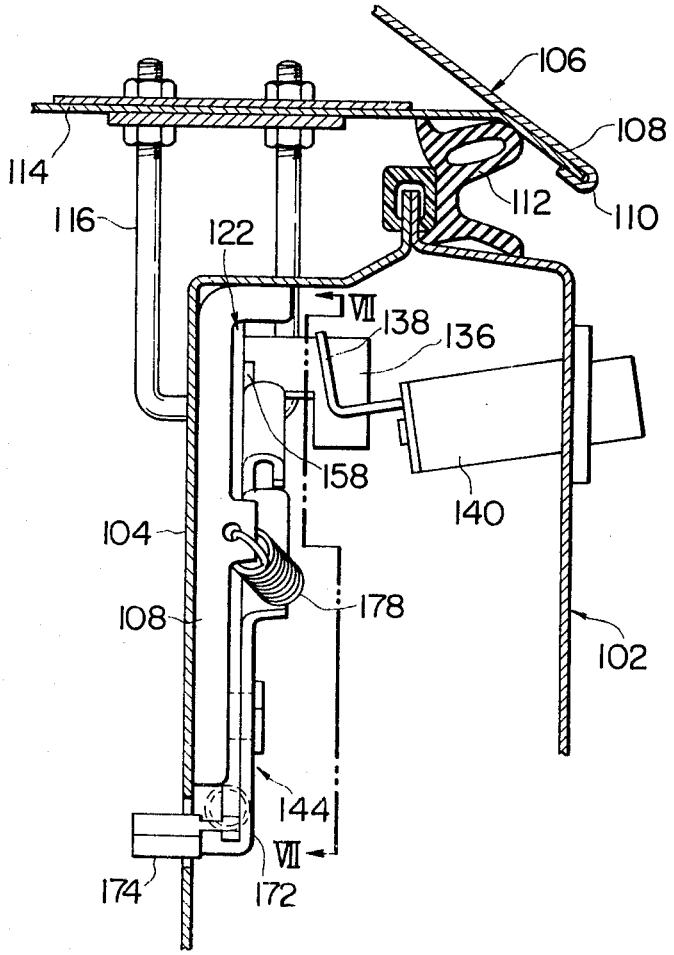
FIG. 6 is a partial sectional view similar to FIG. 1 showing a second embodiment of a latch mechanism according to the present invention.
Figure 7:
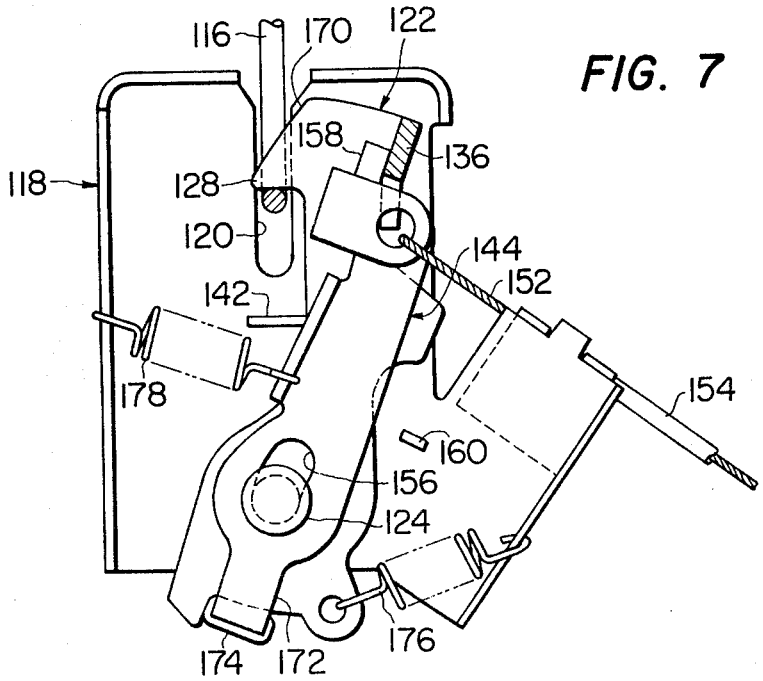
FIG. 7 is a partly sectional view through the line VII—VII of FIG. 6 showing the parts in latched position.
Figure 8:
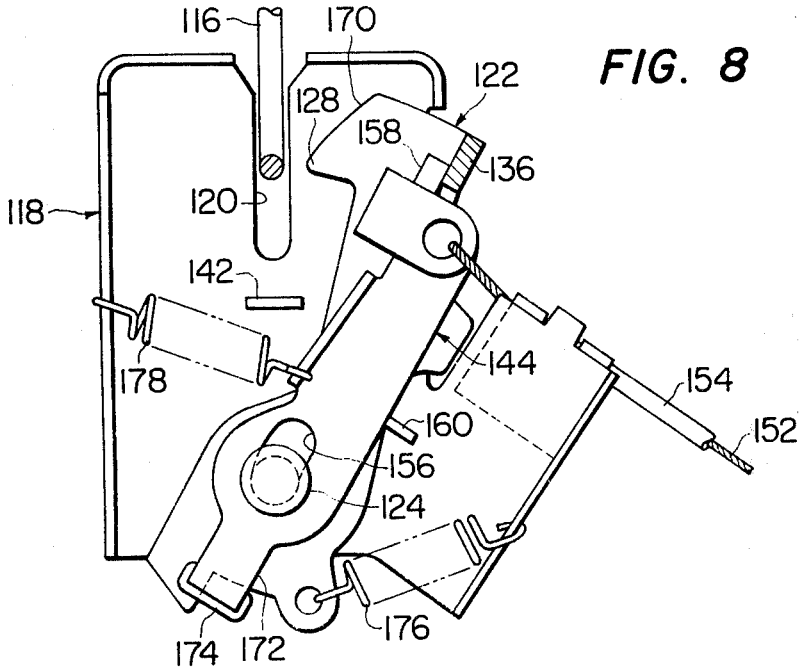
FIG. 8 is a view similar to FIG. 7 showing the parts in open or latched position when a Bowden wire is operated to rock an open lever.

When it is desired to operate the manually operable knob 68 to disable the open lever 44, the lid 6 is lifted to permit a person to rock the cancel lever 50 to the position shown in FIG. 4 or 5 and subsequently the lid 6 is moved to the closed position to prevent the knob 68 from being operated. The lid 6 then will remain engaged and secured even if the push or pull button in the passenger compartment is operated. It will now be understood that because the knob 68 is disposed in the luggage compartment which is closed by the lid 6 no one can open the luggage compartment without the trunk key to operate the cylinder lock 40.

When it is desired to open the luggage compartment so as to operate the knob 68 the trunk key is inserted to the cylinder lock 40 and turned to rock the key lever 38 to disengage the hook 28 from the keeper 16.

The second embodiment of the present invention shown in FIGS. 6–10 is basically similar to that of FIGS. 1–5, and corresponding parts are represented by the same reference numerals increased by 100. Thus, for example, the latch plate 22 in FIG. 7 corresponds to the latch plate 22 in FIG. 2. The main difference is that instead of the stud 46 and cancel lever 50 carrying the manually operable knob 68, an open lever 144 has an actuating arm 172 extending downwardly out of a casing 118 and carrying a manually operable knob 174 which projects into the luggage compartment through an opening 176 formed in an inner plate 104.

Figure 9:
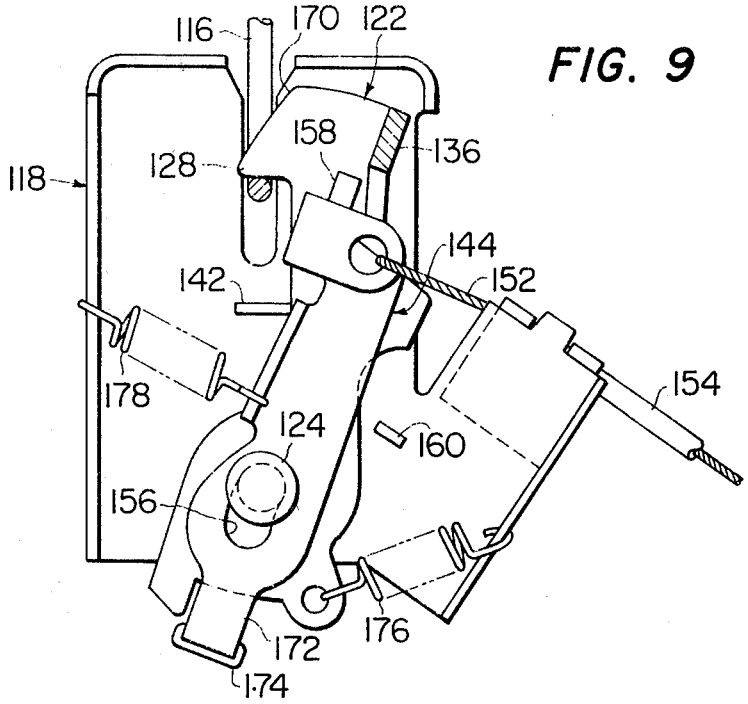
FIG. 9 is a view similar to FIG. 7 showing the parts in latched position with the open lever position out of operative engagement with latch plate.
Figure 10:
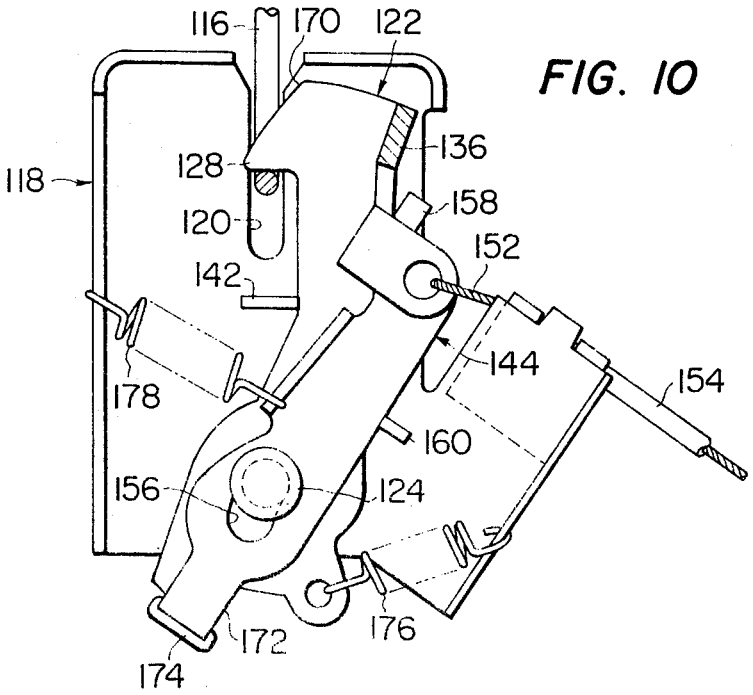
FIG. 10 is a view similar to FIG. 7 showing the parts remaining in latched position when the Bowden wire is operated to rock the open lever.

When it is desired to disable a remote control push, or pull button to prevent any one from opening a lid 106, the manually operable knob 174 is operated to move the cancel lever 150 into the position shown in FIG. 9 in which a finger 158 is positioned out of engagement with an ear 136 in the same manner as in the first embodiment. Alternatively, instead of the coil spring 30 two tension coil springs 176 and 178 may be mounted to urge the latch plate 122 in a counter clockwise direction and open lever 144 in a counter clockwise direction, respectively, as viewed in FIG. 7.

In the embodiment shown in FIGS. 6–10, a slot 156 is curved so as to provide in cooperation with the tension coil spring 178 a snap action for the open member 144.

The latch mechanism according to the present invention has been described in the preceding as attached to a luggage compartment of an automobile, but is may equally be used as a lock for an engine compartment or a lift back door.

If desired, the open lever 44 or 144 may be directly or indirectly connected with an electro magnetic actuator to be operated thereby, the control of the electro magnetic actuator terminating in a control switch in the passenger compartment. The control switch should be lockable by a key and if this is the case the cylinder lock 40 or 144 may be eliminated Although in the foregoing embodiments the open lever 44 or 144 is engageable with the actuating portion 36 or 136 of the latch plate 22 or 122, the present invention may be applied to a latch mechanism comprising a rockable latch and a detent having an actuating portion by mounting an open lever in the proximity of the actuating portion in such a manner that a finger of the open lever is positionable between a first condition in which the actuating portion of the detent is in the path of movement of the finger of the open lever and a second condition in which the actuating portion is displaced out of the path of movement of the finger.

What is claimed is:

1. In an automobile:

a luggage compartment to be closed by a lid;

a passenger compartment;

a latch mechanism having a latch member mounted within said luggage compartment, an open member mounted within said luggage compartment, said latch and open members being in conjoint action in a first condition and out of conjoint action in a second condition, whereby when in said first condition, said open member is operable to move said latch to its open position and when in said second condition said open member is inoperable to move said latch to its open position, and manually operable means for selectively rendering said latch and open members to the first and second conditions, said manually operable means being mounted within said luggage compartment so that when said lid is closed, said manually operable means is inaccessible for being manually operated; and control means mounted within said passenger compartment for actuating said open member, said control means being operable from said passenger compartment only, whereby when said lid is closed with said manually operable means conditioned to render said latch and open members to the second condition, manual operation of said control means is inoperative to move said latch member to its open position.

2. The combination as claimed in claim 1, in which said latch and open members are pivotably mounted about a pivot pin and in which said latch member has an arm formed with an actuating portion which in the first condition is in the path of pivotal movement of said open member and which in the second condition is displaced out of the path of pivotal movement of said open member.

3. The combination as claimed in claim 2, in which said open member is mounted on said pivot pin for radial slidable movement relative to said pivot pin and has a first portion and a finger whereby in the first condition the finger is positioned for engagement with said actuating portion of said arm to pivot said latch member to its open position and which in the second condition the finger is positioned to be radially disposed inwardly of said actuating portion of said arm of said latch member.

4. The combination as claimed in claim 3, in which said manually operable means comprising a toggle operated member, said toggle operated member having a first arm formed with a slot engaging said first portion of said open member and having a second arm formed with a manually operable configuration.

5. The combination as claimed in claim 3, in which said manually operable means takes the form of a manually operable configuration formed on said first portion of said open member.

6. The combination as claimed in claim 2, further comprising a key operable means including a cylinder lock having a key lever positioned for engagement with said actuating portion of said latch member.

7. The combination as claimed in claim 4, in which said open member has slot means whereby said open member is mounted on said pivot pin for said radial slidable movement, and a coiled spring mounted around said pivot pin having an arm abutting said latch and open members to urge said latch member to its latched position, said slot means and said coil spring cooperating to provide a snap action to said open member when said open member is moved from one of said first and second conditions to the other.

8. The combination as claimed in claim 4, in which two tension springs are provided to urge said latch and open members in one rotational direction, respectively.

9. The combination as claimed in claim 3, in which said open member has slot means whereby said open member is mounted on said pivot pin for said radial slidable movement, and a tension spring is provided to urge said open member in one direction, said slot means and tension spring cooperating to provide a snap action to said open member when said open member is moved from one of said first and second conditions to the other.

* * * * *